US005247724A

United States Patent [19]

Hoffman

[11] Patent Number: 5,247,724

[45] Date of Patent: Sep. 28, 1993

[54] AMUSEMENT DEVICE

[76] Inventor: Myrna S. Hoffman, 134 Montclair Ave., Montclair, N.J. 07042

[21] Appl. No.: 719,946

[22] Filed: Jun. 24, 1991

[51] Int. Cl.[5] ..... G09F 1/00

[52] U.S. Cl. ..... 472/63

[58] Field of Search ..... 472/63; 248/146; 108/26, 25

[56] References Cited

U.S. PATENT DOCUMENTS

| | | | |
|---|---|---|---|
| 3,249,070 | 5/1966 | Day et al. | 108/26 |
| 3,834,051 | 9/1974 | Barnes, Jr. et al. . | |
| 4,122,780 | 10/1978 | Brickman | 108/25 |
| 4,909,501 | 3/1990 | Hoffman | 472/63 |

*Primary Examiner*—Richard E. Chilcot, Jr.

*Attorney, Agent, or Firm*—Charles E. Temko

[57] ABSTRACT

An anamorphic amusement device particularly suited for use by children while traveling, and who have access to a cup-retaining device normally used to prevent engaged cups containing a liquid from spillage due to upset. The device includes a cup of generally frustoconical configuration having a reflective outer surface, and a planar orificed mat having an opening corresponding in diameter to that of a medial section of the cup. The device is used by inserting the cup through the orifice and positioning the lower end of the cup in a recess in the cup retaining device which thereby supports the cup and mat in proper relative condition wherein anamorphic images on the upper surface of the mat are viewed as undistorted reflective images on the reflective surface.

5 Claims, 1 Drawing Sheet

AMUSEMENT DEVICE

BACKGROUND OF THE INVENTION

This invention relates generally to the field of amusement devices of the type described in my prior U.S. Pat. No. 4,909,501, granted Mar. 20, 1990 under the title "Anamorphic Amusement Device", to which reference is made. More particularly, it relates to an improved form of device particularly suited for use by children traveling on a train, bus, or aircraft, as distinguished from use while seated in a fast food restaurant or the like.

In my above identified prior patent, there is disclosed an anamorphic amusement device which includes a frusto-conical cup, usually of disposable single use type, an outer surface of which is provided with a reflective member of metallic foil or metallic coated synthetic resinous material. The device also includes a paper place mat having one or more anamorphic images printed thereon which are reflected by the outer surface of the cup in undistorted condition. The place mat has a printed indication of the proper position or positions of the cup thereon to assure this result.

This device is useful principally in locations where the place mat may be positioned on a relatively immobile surface, such as a table supported by a horizontal floor which is not subject to vibration or movement. A typical location of such table is in a fast food restaurant, or in the kitchen of a home.

However, food is often served and consumed in moving vehicles having means for supporting food containers, such as aircraft, trains and buses, as well as automobiles. Such vehicles include selectively positionable table surfaces for supporting plates and cups which are subject movement of the vehicle, such that cups, plates, even when filled with a comestible, cannot reasonably be expected to remain in fixed position. The utility of the device disclosed in my above mentioned patent, in such instances, is, therefore, reduced.

It is known in the art to provide supporting surfaces in vehicles which are provided with cup accommodating recesses. These are usually located near the dashboard of the vehicle, with minimal surface area surrounding the recess.

SUMMARY OF THE INVENTION

Briefly stated, the invention contemplates the provision of an improved device of the class described which is more suitable for use in moving vehicles. To this end, the device includes a planar mat element which is provided with a circular orifice surrounding the location where the bottom wall of the cup would normally be placed. A cup supporting device having a horizontal surface is provided with a through circular opening, the diameter of which is greater than the diameter of the bottom wall of the cup, whereby it supports the cup either by contact with a side wall thereof, or engagement of the bottom wall by a parallel surface of a wall forming a recess disposed inwardly of the opening in the horizontal surface. Thus, should the longitudinal surface be moved, the mutual relation between the cup and the place mat remains undisturbed.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
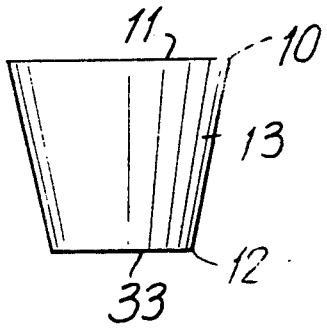
FIG. 1 is a side elevational view of a frusto-conical cup forming a part of the disclosed embodiment of the invention.
Figure 2:
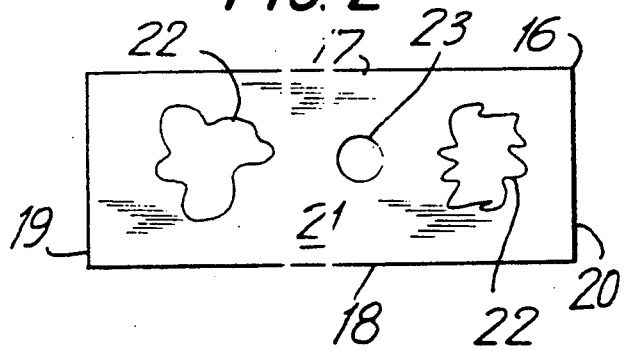
FIG. 2 is a top plan view of a planar place mat element forming a part of the embodiment.

In accordance with the invention, reference character 10 (FIG. 1) designates a frusto-conical drinking cup of disposable type bounded by an upper edge 11, a lower edge 12, between which a reflective frusto-conical side surface 13 extends. Referring to FIG. 2, reference character 16 designates a planar mat element, usually of paper or other similar material, bounded by a pair of longer edges 17 and 18, and a pair of shorter edges 19 and 20 enclosing an upper surface 21 having one or more printed anamorphic images 22 and an index location in the form of a circular opening 23.

Figure 3:
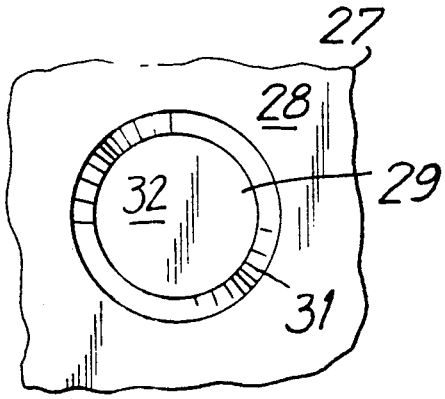
FIG. 3 is a fragmentary top plan view of a horizontal supporting surface member having cup supporting structure incorporated therein.

Referring to FIG. 3, reference character 27 designates an upper wall defining a horizontal surface 28 including a recess 29 of frusto-conical configuration. The recess has a principal axis which is generally vertically oriented, and includes a tapered or cylindrical side wall 31 and a bottom wall 32 corresponding in area generally to that of the bottom wall 33 of the cup 10.

Figure 4:
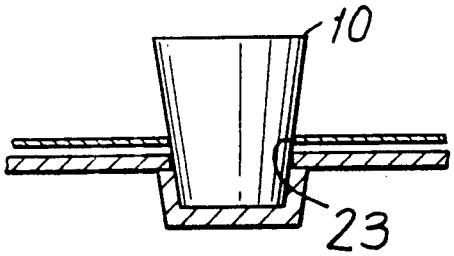
FIG. 4 is a fragmentary vertical sectional view showing the device in use.

FIG. 4 illustrates the above elements in assembled condition. Where the horizontal supporting surface is part of a known convention cup retainer disposed in a vehicle, the areas surrounding the recess will normally be quite small. In such case, the second planar mat element can be made of heavier paper or corrugated material so as to maintain a degree of planar rigidity when it is supported only in the areas surrounding the opening 23. Owing to the tapered configuration of the cup and the close engagement of the outer surface of the same with the opening in the second element, it will be appreciated that the cup cannot be readily shifted unintentionally out of the recess or opening, and the mat cannot shift in a horizontal direction owing to its close engagement with the cup. Thus, vibration and shaking normally encountered while traveling in the vehicle does not affect the use of the device. When it is desired to substitute the mat element, it is necessary only to lift the glass, disengage the in use second element, and substitute a desired one.

Figure 5:
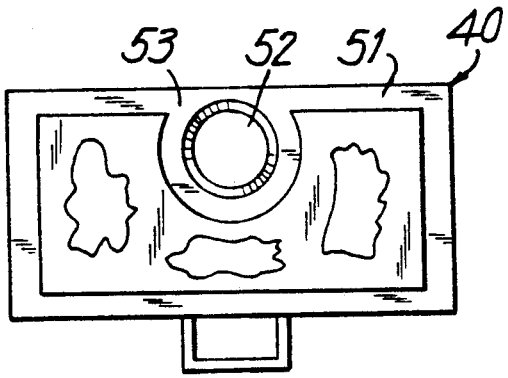
FIG. 5 is a top plan view of a second embodiment of the invention.
Figure 6:
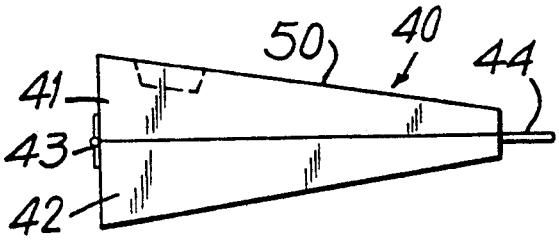
FIG. 6 is a side elevational view thereof.

In many cases, the vehicle in which the user is traveling does not have any provision whatsoever for the support of a drinking cup or the like, in which case, it is possible to support the assembly upon the legs of a seated user. FIG. 5 illustrates a small child's tote case which may be manufactured at relatively modest cost using injection molding techniques. The case 40 includes first and second molded symmetrical halves 41 and 42 interconnected by hinge means 43 and provided on an opposite side with a carrying handle 44. When used by a child, a supply of second planar elements (not shown) can be carried within the case 40 for selective use, and where a drinking cup is not available, this may be substituted by a separate reflective member disclosed in my above-mentioned patent.

The first half 41 is bounded by a peripheral edge 50 bordering a side wall 51 which incorporates a molded recess 52 extending from an outer surface 53. As best seen in FIG. 5, this recess is preferably not centrally located, but is positioned adjacent a segment of the peripheral edge which will be most distant from the eyes of the user when in use, to thereby enable the user to enjoy something more than 180 degrees visibility with respect to the reflective surface of the cup.

In use, the user merely opens the case 40, selects the desired planar element, and positions it on the surface 53, anchoring the same by inserting the cup in the aligned openings in the selected element and the surface 53 The case is then closed and supported in the lap of the user when in seated condition. When use has been terminated, the case is again opened, and the first and second elements stored therein for subsequent use.

It may thus be seen that I have invented novel and highly useful improvements in anamorphic devices of the type described, in which the utility of such devices is extended for use in locations where the device is not readily supported for observation by a user. In the present disclosed embodiments, the cup-like reflective element is positively anchored with respect to the planar mat disposed therebeneath by projecting through an opening in the latter, and a corresponding opening in a supporting surface disposed beneath the mat element.

I wish it to be understood that I do not consider the invention to be limited to the precise details of structure shown and set forth in the specification, for obvious modifications will occur to those skilled in the art to which the invention pertains.

I claim:

1. In an anamorphic amusement device including a first frusto-conically shaped element defining an outer reflective surface, a planar element having a surface displaying an anamorphic image and an indexed location for placement of said conically shaped element thereupon for viewing of said anamorphic image in undistorted form, in combination with a planar surface supporting said first and second elements, the improvement comprising: said indexed location defining a circular opening of diameter corresponding to that of a medially positioned section of said first element, said supporting surface defining an opening therein of substantially the same diameter; whereby upon the assembly of said first and second elements in combination with said planar surface, said first element is projected through said opening in said second element, and said opening in said surface in alignment therewith to a point wherein said outer surface engages the edges of said opening in said second element and said supporting element, wherein said first and second elements are prevented from shifting laterally during use.

2. The improvements set forth in claim 1, in which said supporting surface defines a circular recess extending downwardly therefrom bordered by a cylindrical side wall and a bottom wall, said bottom wall having a diameter equivalent to the diameter of a lower edge of said first element.

3. The improvement as set forth in claim 1, in which said second element includes plural anamorphic images and corresponding plural index locations.

4. The improvement set forth in claim 2, in which said second element includes plural anamorphic images and corresponding index location.

5. The improvements set forth in claim 1, in which said planar surface supporting said first and second elements is that of a side wall of a piece of luggage, said side wall incorporating a cup holding recess extending inwardly from said surface.

* * * * *